US010463939B2

(12) United States Patent
Baker

(10) Patent No.: US 10,463,939 B2
(45) Date of Patent: Nov. 5, 2019

(54) GOLF SWING TRAINING DEVICE

(71) Applicant: David Keith Baker, Sydney (AU)

(72) Inventor: David Keith Baker, Sydney (AU)

( * ) Notice: Subject to any disclaimer, the term of this patent is extended or adjusted under 35 U.S.C. 154(b) by 53 days.

(21) Appl. No.: 15/562,803

(22) PCT Filed: Mar. 29, 2016

(86) PCT No.: PCT/AU2016/050235

§ 371 (c)(1),
(2) Date: Sep. 28, 2017

(87) PCT Pub. No.: WO2016/154671

PCT Pub. Date: Oct. 6, 2016

(65) Prior Publication Data

US 2018/0185730 A1 Jul. 5, 2018

Related U.S. Application Data

(60) Provisional application No. 62/139,645, filed on Mar. 28, 2015.

(51) Int. Cl.

| | |
|---|---|
| ***A63B 69/36*** | (2006.01) |
| ***A63B 71/02*** | (2006.01) |
| ***A63B 71/06*** | (2006.01) |

(52) U.S. Cl.

CPC ..... *A63B 69/3641* (2013.01); *A63B 69/3623* (2013.01); *A63B 69/3676* (2013.01); *A63B 71/023* (2013.01); *A63B 69/3667* (2013.01); *A63B 2069/3629* (2013.01); *A63B 2069/3682* (2013.01); *A63B 2071/0694* (2013.01); *A63B 2210/50* (2013.01); *A63B 2225/09* (2013.01); *A63B 2225/093* (2013.01)

(58) Field of Classification Search

CPC ..... A63B 69/3641; A63B 69/3623; A63B 69/3676; A63B 71/023; A63B 69/3667; A63B 2225/093; A63B 2225/09; A63B 2069/3682; A63B 2071/0694; A63B 2210/50; A63B 2069/3629

See application file for complete search history.

(56) References Cited

U.S. PATENT DOCUMENTS

| | | | | |
|---|---|---|---|---|
| 2,669,782 A * | 2/1954 | Turner | A63B 69/36 | 473/268 |
| 3,827,696 A * | 8/1974 | Schafer | A63B 69/0079 | 473/147 |
| 6,746,339 B1 * | 6/2004 | Thibaudeau | A63B 69/3641 | 473/267 |
| 7,172,513 B1 * | 2/2007 | Rinker | A63B 53/065 | 473/219 |

* cited by examiner

*Primary Examiner* — Jeffrey S Vanderveen

(74) *Attorney, Agent, or Firm* — GSS Law Group; Gregory S. Smith; Phillip M. Wagner

(57) ABSTRACT

A golf swing training device comprises an upwardly extending support to be positioned on the ground in front of a golfer; a visual guide mounted on the support; the visual guide including a golf-ball viewing window through which a golf-ball is viewed by the golfer. The size of the viewing window may be adjustable.

12 Claims, 16 Drawing Sheets

GOLF SWING TRAINING DEVICE

FIELD OF THE INVENTION

The present invention relates to a golf swing training aid.

BACKGROUND OF THE INVENTION

The ability of a golfer to deliver good performance significantly depends on the quality and consistency of his or her swing. Steady swings which consistently produce trajectories that overlie or follow the target lines are desired. To this end, golfers need to achieve a proper address set-up, including assuming a stance that allows a proper alignment between the golfer, the club, the ball, and the target. A proper stance also relies on the golfer having the correct overall posture, including coordinated body and head positions. The set-up then allows the golfer to carry out the complex motion in a golf stroke, whereby he or she stably swivel and shift his or her body weight along an appropriate swing plane, to produce a true strike with appropriate power. These and other various facets of a good game are technically complex and difficult to master. For example, it is difficult to produce an accurate aim while standing sideways to the target at address. Some golfers tend to move their heads during their swings. An excessive amount of head movement impacts the weight-shifting during the swing and reduces stability. Therefore it is desirable for a golfer to keep his or her head relatively still from address to impact. Therefore, training aids exist in the sporting goods market which help users practice and perfect various parts of their games, including those that help users practice how to reduce excessive head movements during their swings.

Any reference herein to known prior art does not, unless the contrary indication appears, constitute an admission that such prior art is commonly known by those skilled in the art to which the invention relates, at the priority date of this application.

SUMMARY OF THE INVENTION

The present invention provides a golf swing training device comprising: an upwardly extending support to be positioned on the ground in front of a golfer; a visual guide mounted on the support; the visual guide including a golf-ball viewing window through which a golf-ball is viewed by the golfer during practice.

The guide can further comprise a window through which a golf club swinging towards the golf-ball can be observed.

The golf-ball viewing window can be adjustable in size.

The visual guide can comprise two portions that are movable relative to each other, their relative position determining the size of the golf-ball viewing window.

The portions can be longitudinally movable relative to each other.

One of the two portions can include a channel in which the other one of the two portions can move.

The visual guide can be transversely and swivellably mounted on the support means, wherein the visual guide is adapted to rotate about a longitudinal axis through an end of the support means.

The visual guide can include a protractor for indicating an angular position of the visual guide relative to the support.

The support means can include a plurality of pivotably connected segments, the segments being pivotable relative to each other about a generally horizontal axis.

The support means can include three pivotably connected segments.

The support means can include a peg for insertion into the ground.

The golf swing training can have a stand for supporting the support means on a hard surface or ground.

Further, the training device may be adapted to be reconfigured between left-handed and right-handed configurations.

Further features of the invention will be apparent from the detailed description and drawings, and from the claims.

BRIEF DESCRIPTION OF THE DRAWINGS

An embodiment or embodiments of the present invention will now be described, by way of example only, with reference to the accompanying drawings, in which:

FIG. 11*d* is a perspective view of a spike attachable to the upright arm shown in FIG. 10*a* and FIG. 10*b;*

DETAILED DESCRIPTION OF THE EMBODIMENT OR EMBODIMENTS

Figure 1:
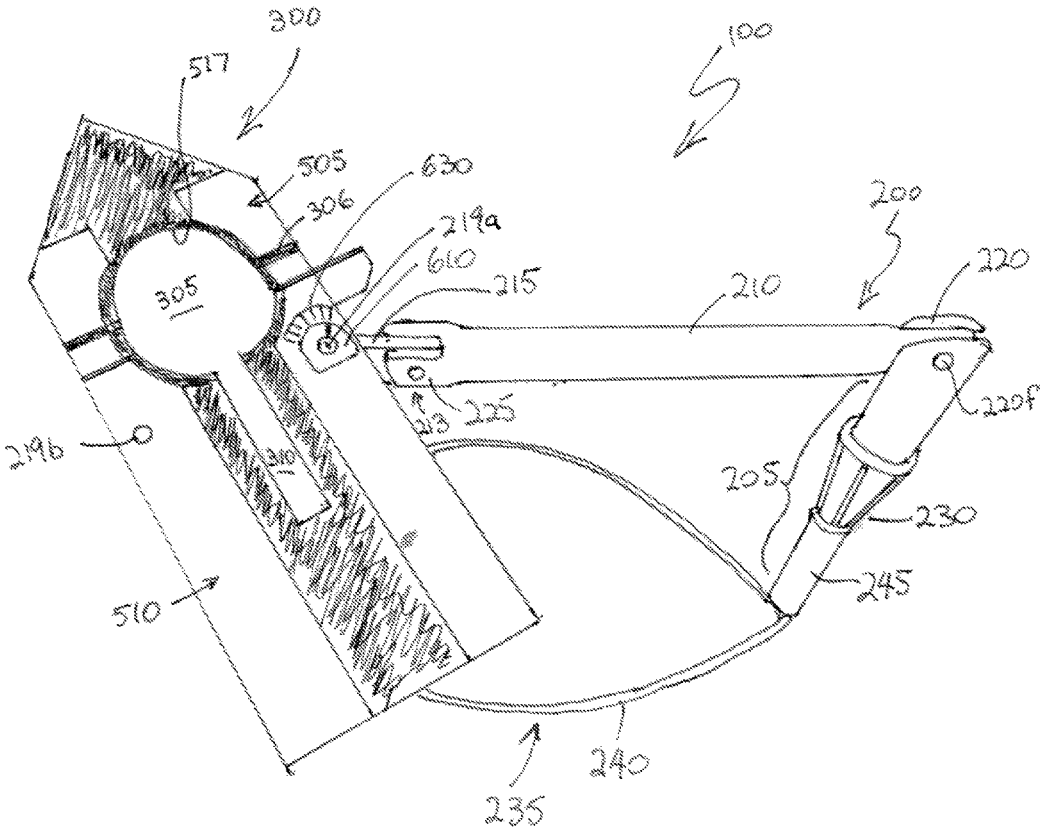
FIG. 1 is a perspective view of a golf training device with support and stand.

FIG. 1 depicts a golf training device 100, comprising a ground support 200, and a visual guide 300 attached to an end portion of the support 200. The other (lower) of the support 200 is adapted to stand or be secured on a surface. The visual guide 300, which is attached to the other end of the support 200 helps train the user to keep his or her head steady, and guide the user's swing. The device 100 is adjustable to suit users of different heights and hand-dominance, and to suit different clubs, in setting up an appropriate position of address. The training device 100 is intended to be usable with clubs including the driver, the long iron, the short iron, and the putter.

The support 200 includes a plurality of segments or legs which are pivotably connected. The plurality of segments includes a lower upright segment 205, a middle "pivot arm" segment 210, and an upper "visual guide arm" segment 215. The segments are pivotably connected with respect to each other. As described in more detail later, the pivot arm 210 connected to the upright 205 at a first hinge 220, and the visual guide arm 215 is connected to the pivot arm 210 at a second hinge 225.

The support 200 can include a stand 235 for use with a hard surface (e.g. concrete). The stand 235 includes a base 240 that is, in use, placed on the hard surface for support. The stand 235 can be one-piece with the upright 205. Alternatively, the stand 235 has a receptacle for connection of the upright (or vice versa). For example, the stand 235 can further include a receptacle such as a sleeve or tube 245 which partially receives the lower leg 205, so as to stably hold the support 200. The sleeve 245 and the lower leg 205 are dimensioned so that the lower leg 205 snugly fits into the sleeve 245, to ensure stability of the device. The lower end 230 of the upright 205 can optionally be tapered, for example, in the form of a peg or a tapered stake, which allows the support 200 to be secured into the ground (e.g. grass, sand, or dirt). It will be understood that the upright 205 can have other configurations that allow it to engage soft surfaces (grass, sand dirt) or hard surfaces (e.g. concrete, tiled floor etc). These are discussed below with reference to FIGS. 7*d*, 7*e*, and 7*f*.

The upright 205 is pivotably attached to one end of the pivot arm 210 at a first hinge 220. The upright 205 and the pivot arm 210 are elongated. They can each have a major extent that is shaped like a tubular post, or a cylinder. The visual guide support 215, however, can be shorter, as its purpose is to support the visual guide 300 at different pivot and swivel angles, as will be explained later.

As shown in FIG. 7*a*, the upright 205 further has an upper end 231 opposite its lower end 230 (not shown). The upright 205 includes a pair of end tabs or extensions 220*a*, 220*b* which extend longitudinally away from the upper end 231. The tabs 220*a*, 220*b* are spaced from each other by gap 220*c*, and have aligned openings 220*d*, 220*e*.

The lower end 230 of the upright 205 can have one of several configurations. It can be include the configuration shown in FIG. 1, whereby it is stably received and supported by a ground support stand 235. Alternatively, the lower end can simply include a tapered portion insertable into grass, sand, or dirt (FIG. 7*d*), for embodiments intended to work only on soft surfaces into which the lower end 230 can be inserted. The upright 205 can alternatively include or be attachable to a stand 240 which enables the upright to stand on a hard surface (FIG. 7*e*). In further embodiments where the base and the ground insertion peg are separate, the upright includes a wide enough base to stand on a hard surface, and can be further secured on its bottom to a separate stake, peg, or tapered end 236 insertable into the ground (FIG. 7*f*).

As shown in FIG. 7*b*, the pivot arm 210 includes a first end portion 211 and an opposite second end portion 213. The first end portion 211 can include, or be, a tapered or thinned part compared to the middle portion of the pivot arm 210. The tapered end 211 includes an opening 211*a*. The second end portion 213 of the pivot arm 210 includes a pair of end tabs or extensions 225*a*, 225*b* which extend longitudinally away from the second end 213. The pair of end tabs or extensions 225*a*, 225*b* are spaced apart by gap 225*c*, and have aligned transverse openings 225*d*, 225*e*.

As shown in FIG. 7*c*, the visual guide support 215 is a generally planar segment with includes a first end 270 and a second end 275. The first end 270 in use is adapted to be received by the gap 225*c*. The first end 270 and the second end 275 are connected by an upper edge 276 and a lower edge 277 of the visual guide support 215. A first opening 270*a* through the visual guide support 215 is provided adjacent the first end 270. A second opening 275*a* is provided into an upper edge 276, adjacent the second end 275. The axis of the second opening 275*a* is perpendicular to the axis of the first opening 270*a*.

Referring again to FIG. 1, to assemble the pivot arm 210 to the upright 205, the thin end 211 of the pivot arm 210 is inserted into the gap 220*c* between the end tabs 220*a*, 220*b* of the upright. The components are positioned so that the aperture 211*a* in the thinned end 211 of the pivot arm 210 is aligned with the openings 220*d*, 220*e* in the upright 205. A first connector such as a bolt, screw, or the like 220*f* passes through the aligned openings 221*a*, 220*d*, 220*e*. A nut (not shown) is tightened on the connector to clamp the end walls 220*a*, 220*b* of the upright 205 and the thinned end 211 together. Alternatively, a cam lock (not shown) can be used instead of the nut for the clamping function. The pivot arm 210 is thus pivotable relative to the upright 205 about a generally horizontal first pivot axis through the connector 220*f*. The angular position of the pivot arm 210 relative to the upright 205 is secured by the nut which acts as an angular position lock.

The visual guide support 215 may be assembled with the pivot arm 210 in the same manner that the pivot arm 210 is secured to the upright 205. The visual guide support 215 is inserted into the gap 225*c* between the paired tabs 225*a*, 225*b* (FIG. 7*b*) of the pivot arm 210, so that the through aperture 270 is in alignment with the aligned openings 225*d*, 225*e*. A second connector 225*f* is the inserted through the openings 270, 225*d*, 225*e*, to secure the parts together, forming a second hinge or second hinged connection 225. A clamp or a nut (not shown) is provided to clamp the paired tabs 225*a*, 225*b* and the visual guide support 215 together. The visual guide support 215 is thereby pivotable relative to the pivot arm 210 about a generally horizontal second pivot axis through the connector 225*f*, the clamp acting as a position lock when the visual guide support has been pivoted by the desired amount.

The outer surfaces of either or both of the paired tabs 220*a*, 220*b* of the upright 205 can include indicia, such as angular markings, which help the user reference the amounts of angular rotation between the pivot arm 210 and the upright 205. Similarly indicia or markings can be applied to the outer surfaces of either or both of the paired tabs 225*a*, 225*b* of the pivot arm 210, to help the user reference the amounts of angular rotation between the pivot arm 210 and the visual guide support 215.

To assemble the visual guide 300 to the visual guide support 215, a third connector 219*a* such as a screw, rivet, or bolt, is inserted through a dedicated opening through the visual guide 300, for example adjacent one long edge of the visual guide, and into the opening 275*a* in the side edge 276 of the visual guide support 215. A flat piece 610, such as a washer can provided between the visual guide 300 and the head of the screw 219, to help evenly distribute the load. The flat piece 610 can thus help protect the surface of the visual guide 300 around the third connector 219*a* from being worn out. The third connector 219*a* is tightened through the visual guide 300, and into the visual guide support 215, to clamp the visual guide 300 between an enlarged head of the connector 219*a*, or a washer 610, or both, and the visual guide support 215. The opening 275*a* which receives the connector 219*a* can include a screw thread to cooperate with the connector 219. Alternatively the connector 219*a* can be a self-drilling screw, drilled into the side edge 276 of the visual guide support 215 thereby forming the opening 275*a*. The screw 219*a* can be tightened by e.g. a nut (not shown), so as to clamp the visual guide 300 onto the side edge 276 of the visual guide support 215.

The visual guide 300 is thereby able to swivel about the third connector 219*a*, along the of the upper side edge 276 of the visual guide support arm 215. Once a desired swivel angle is reached, the relative positions of the visual guide 300 and the visual guide support 215 are not changed, until the user moves the parts further.

Figure 2:
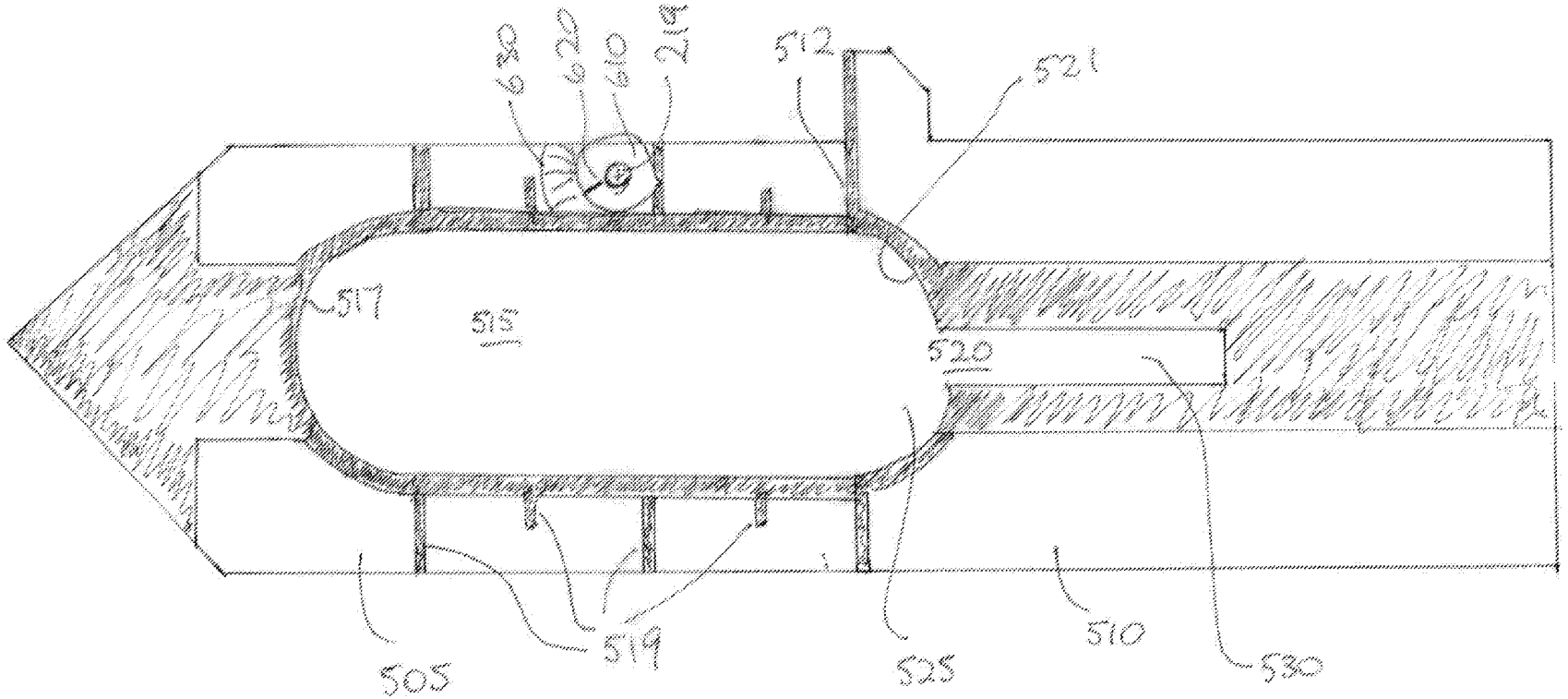
FIG. 2 is a top view of a visual guide in its extended condition.

As can be seen in FIG. 2, the washer 610 can also include a reference line 620 which passes through the connecting means 219. Correspondingly, the visual guide 300 can include a plurality of angular markings 630. Each angular marking 630 includes or corresponds to a part or the entirety of an angular line that emanates from the pivot point which coincides with the centre of the connecting means 219. As the visual guide 300 is rotated about the upper leg 215, the flat piece 620 and the connecting means 219 remain fixed in relation to the upper leg 215. Therefore, by aligning the reference line 620 with different angular markings 630, the user can ascertain the amount of angular rotation that has been made. The angular markings 630, and the flat piece 610 with its reference line 620, thereby provide a protractor that enables the user to swivel the visual guide 300 to the desired angle, and/or note the angular position for future reference.

A similar third connector 219*b* (FIG. 3), reference line and angular markings (not shown) may be provided adjacent the opposite long edge of the visual guide 300, allowing the guide to be connected so that it points right (as seen by the user) rather than left. The device is therefore reconfigurable to suit both left- and right-handed golfers.

The pivot connection between the upright 205 and the pivot arm 210, the pivot arm and the visual guide support 215, or the transverse swivel connection between the visual guide 300 and the visual guide support 215, can be achieved by other structures. For example, adjacent portions of the upright 205 and the pivot arm can be overlapping portions, which are locked together by a screw which is passed through the overlapping portions. The screw can be tightened by a nut to clamp the portions together. The screw is thus the pivot axis for the pivot arm 210 relative to the upright 205. The same arrangement can be repeated for the connection between the visual guide support 215 and the pivot arm 210, and that between the visual guide 300 and the visual guide support 215.

In another example, the pivot connection can be stepped. For example, relatively thin or flat overlapping portions of the upright 205 and the pivot arm 210 can both be mounted on an axle, which is the pivot axis. One of the overlapping portions can have a series of evenly spaced, circumferentially provided through holes. The other one of the overlapping portion can have a single through hole that is spaced from the axle by the same distance as each of the series of holes. The pivot arm 210 is rotated by different amounts by aligning the single through hole with a different one of the series of evenly spaced, circumferentially provided through holes. The angular position can then be locked by placing, e.g. a locking member or bar through the aligned holes on the overlapping portions.

As can be seen in FIG. 1, the visual guide 300 is of a generally planar construction, with an elongated shape. The specific shape is not a limiting factor, but can be a rectangle, an arrow shape, or others. The guide 300 includes a first cut-out, aperture or window 305 for viewing the golf ball. The guide 300, being attached to the pivotable visual guide support 215 in the support 200, can be moved to different angular positions, so that the golf ball will be visible to a user while he or she is standing at various distances from the golf ball. The cut-out, aperture or window 305 is dimensioned to allow the entire golf ball to be viewed. The ability to view the golf ball enables the user to better train his or her eye, and head, on the golf ball, during the swing. The cut-out, aperture or window 305 provides a golf-ball viewing window. The window 305 can be a cut-out, or it can be made from a transparent material through which the golf-ball can be observed.

The guide 300 further includes a second slot, cut-out, or window 310 for observing the head the golf club during the swing, as it approaches the ball. The slot or second window 310 is a longitudinal opening or window which leads into the first aperture or window 305. The first and second windows 305, 310 are axially aligned, so that the axis of the slot 310 aligns with a centre of the golf ball viewing window 305. The slot 310 and golf ball viewing window thus form a shape which may be described as a "keyhole shape", and may together be considered a keyhole opening or window.

The ability to view the head of the golf club helps the user ensure the swing follows a straight path aligned to hit the centre of the golf ball. The slot 310 therefore provides a swing alignment window. The slot 310 is of sufficient width for the user to clearly observe the head of the golf club. It can also be made narrow enough so that a particular part (e.g. a marked part) of the golf club can be observed through the slot, to better ensure positioning of the golf club.

In one embodiment, the guide 500 can be adjustable. As shown in FIG. 2, an adjustable guide 500 can comprise two portions 505, 510 that are longitudinally aligned with, and movable relative to each other. The two portions 505, 510 can be telescoping portions. The portion which is located closer to the target is referred to as the front portion 505, and the portion which is located farther from the target is referred to as the rear portion 510. The rear portion 510 partially overlies the front portion 505, or vice versa. The portions 505, 510 are longitudinally movable relative to each other. The construction of the guide portions 505, 510 is discussed with reference to FIGS. 3 to 6 below.

Referring again to FIG. 2, the front guide portion 505 includes a front aperture or window 515. A front edge 517 of this aperture 515 can be curved, arcuate, semi-circular, or have any other shape and dimensions which allow the viewing of the golf-ball. The rear guide portion 510 includes a rear window 520 which extends from the front edge 512 of the rear guide portion 510. The rear window 520 is axially aligned with the front window 515 when the front and rear guide portions are assembled. The front window 515 can have an elongated shape, along the longitudinal axis of the front guide portion 505. As the guide portions 505, 510 are assembled, the rear guide portion 510 is moved forward relative to the front guide portion 505. The user can see the golf ball via the part of the front window 515 that is not covered by the rear guide portion 510.

The rear window 520 can have a wider first port or cut-out 525 which extends from the front edge 512 of the rear guide portion 510. The rear window 520 further includes a second port or cut-out 530 which is adjacent the first port 525 and which extends longitudinally toward the rear edge 514 of guide portion 510. The second port 530 is narrower, as measured transversely across the longitudinal axis of the visual guide 500, than the first port 525. The wider first port 525 of the rear window 520 can have a width to match the width of the aperture 515 in the front guide portion 505. The rear slot 520, more specifically its wider first port 525, can also have a shape that complements a shape of the front window 515. For example, the front edge 517 of the front window 515 and the front edge 521 of the rear window 520 are both semi-circular. An obround or circular golf-ball viewing window, depending on the position of the rear guide portion with respect to the front guide portion, can thus be formed when the guide 500 is assembled. The front guide portion 505 can include a marking or guide line 506. The guide line 506 can be positioned so that when the front edge 512 of the rear guide portion 510 aligns with this guide, the golf-ball viewing window 515 is a perfect circle.

When the front and rear guide portions 505, 510 are assembled, the part of the front window 515 that is located forward of the rear guide portion 510 forms a golf ball viewing window. The second port 530 of the rear window 520 acts as a swing-alignment window.

The front portion 505 can include markings 519 adjacent the side window 515, to help user set or determine the relative position of the rear guide portion 510 with respect to the front guide portion 505. The overall length of the guide 500 can be adjusted by sliding the two portions 505, 510 relative to each other. The observation windows for the golf ball and swing are also lengthened or shortened depending on the relative positions of the guide portions. Insignia or a visual design can be applied to the front portion 505 or rear portion 510, or both, to show user how the portions should be oriented. For instance, an arrow can be printed or painted on the guide 300, 500 as a visual alignment aid. The front guide portion 505 can also be shaped like an arrow or be wedge shaped, at least along its front end.

Figure 3A:
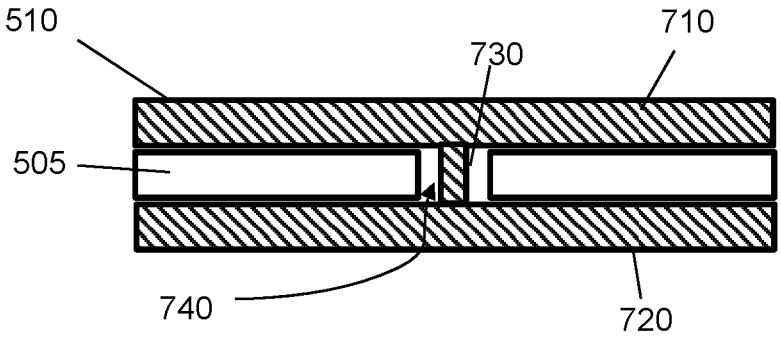
FIG. 3*a* shows a schematic cross section of a visual guide where the rear guide portion and is slidable with respect to the front guide portion portion.
Figure 3B:
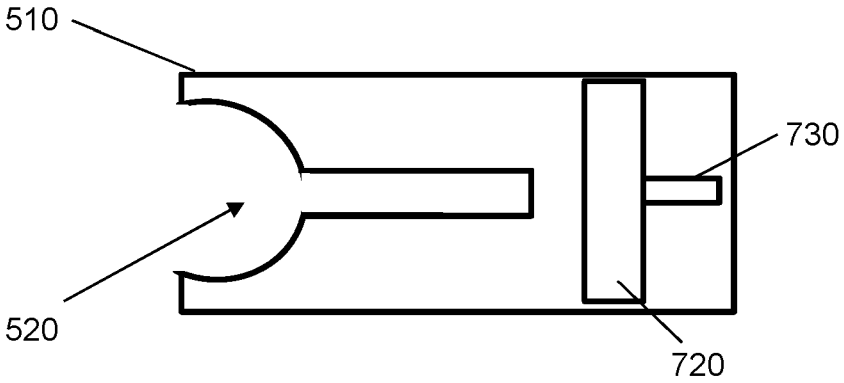
FIG. 3*b* shows a plan view of the underside of the rear guide portion shown in FIG. 3*a;*
Figure 3C:
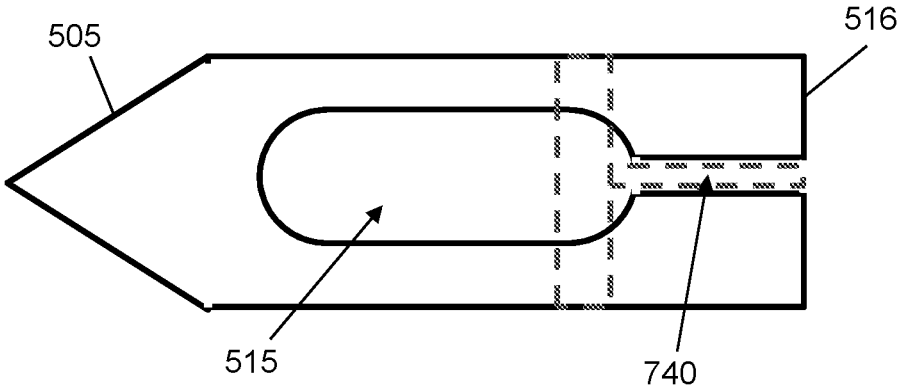
FIG. 3*c* shows a plan view of the front guide portion shown in FIG. 3*a;*

FIGS. 3*a* to 3*c* depict an exemplar construction of how the two guide portions 505, 510 can slide relative to each other. As shown in FIGS. 3*a* and 3*b*, the overlying portion can be the rear guide portion 510. The rear guide portion 510 includes a main panel 710 which includes the rear window or cut out 520 as previously mentioned. The main panel 710 carries, on its underside, an under panel or bar 720. The under panel or bar 720 is located rearward from the rear window 520, so as to not to intrude in the viewing area. The under panel or bar 730 is preferably no wider than the rear guide portion 510. The under panel or bar 720 is vertically spaced from the main panel 710 by a centrally located spacer 730. The distance between the under panel or bar 720 and the main panel 710 is sufficient to accommodate, and preferably, generally the same as, the thickness of the front guide portion 505. As shown in FIG. 3*c*, the front guide portion 505 includes a longitudinal central passage 740. The central passage 740 opens from the front guide window 515 to the rear edge 516 of the front guide portion 505. As shown in FIG. 3*a*, the spacer 730 in the rear guide portion 510 is adapted to be received by the passage 740 in the front guide portion 505.

To assemble the guide portions 505, 510, the rear guide portion 510 is moved toward the rear edge 516 of the front guide portion 505, the spacer 730 of the rear guide portion 510 being aligned with the passage 740 in the front guide portion 505. As the spacer 730 is moved into the passage 740, the front guide portion 505 is held between the main panel 710 and the under panel 720. The rear guide portion 510 can then be slidably moved with respect to the front guide portion 505, by moving the spacer 730 along the passage 740. The dashed lines in FIG. 3*c* depicts the position of the spacer 730 and under panel 720 of the rear guide portion 510 with respect to the front guide portion 505.

Figure 4:
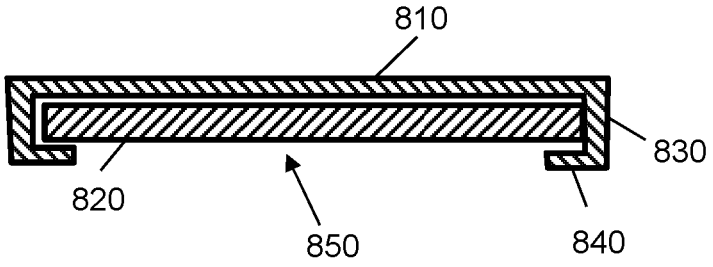
FIG. 4 shows a schematic view of a visual guide where an overlying portion includes a flange, bracket, or sidewall to carry the underlying portion.
Figure 5:
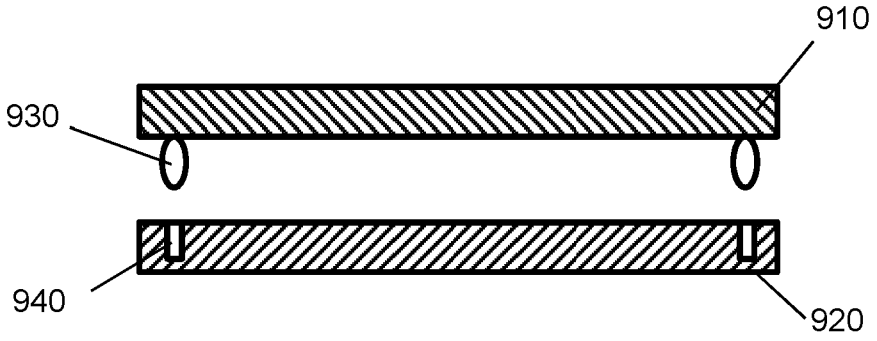
FIG. 5 shows a schematic view of a visual guide where the overlying portion and the underlying portion are assembled by male-female connectors.
Figure 6:
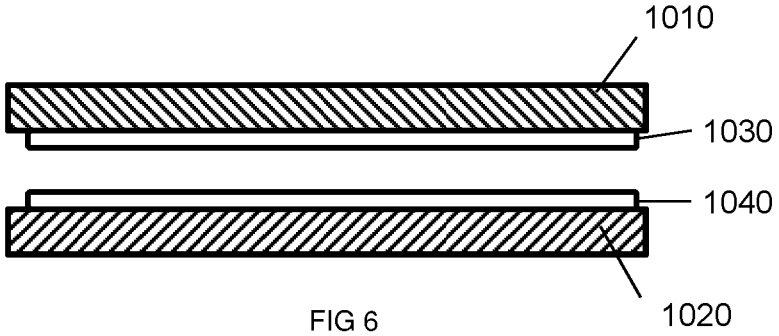
FIG. 6 shows a schematic view of a visual guide where the overlying portion and the underlying portion are assembled in a hoop and loop arrangement.
Figure 7:
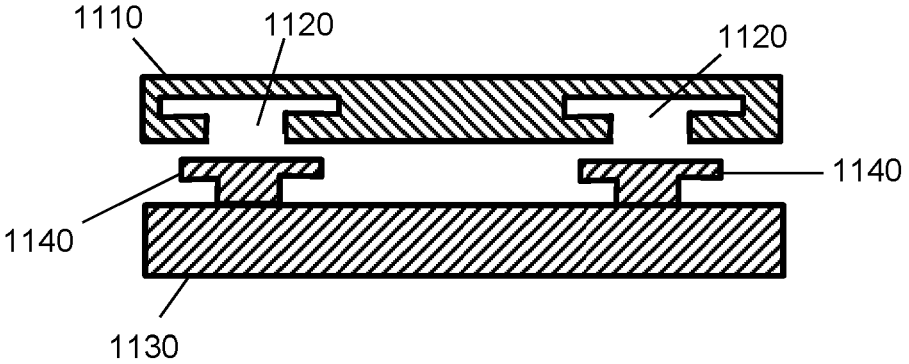
FIG. 7 shows a schematic view of a visual guide where the overlying portion and the underlying portion are assembled by co-operating tracks and ribs.
Figure 8A:
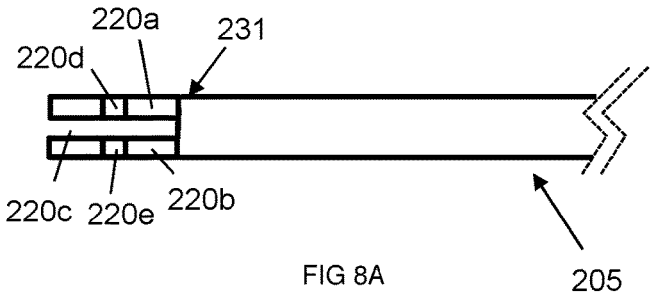
FIG. 8*a* depicts a side view, rotated by 90 degrees, of an upper end of the upright.
Figure 8B:
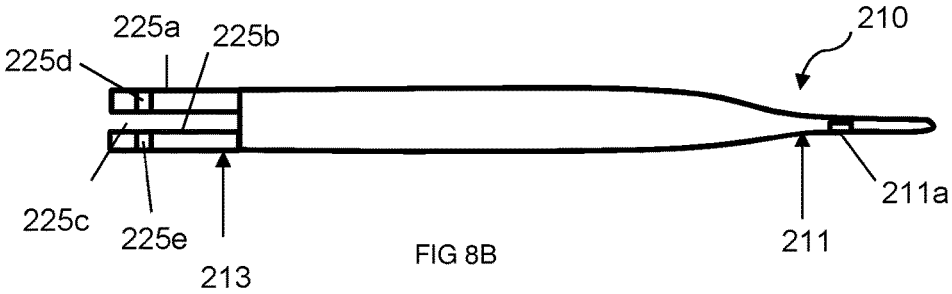
FIG. 8*b* shows a side view, rotated by 90 degrees, of a pivot arm support.
Figure 8C:
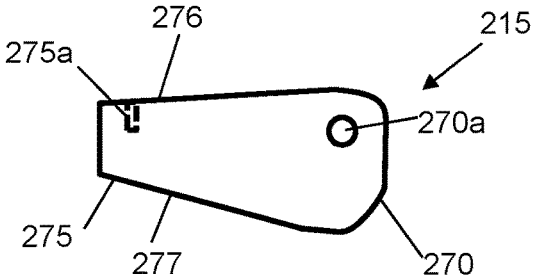
FIG. 8*c* is a side view of a visual guide support.
Figure 8D:
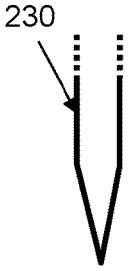
FIG. 8*d* is a side view of a lower end of a upright segment in one embodiment.
Figure 8E:
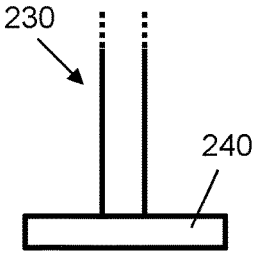
FIG. 8*e* is a side view of a lower end of a upright segment in another embodiment.
Figure 8F:
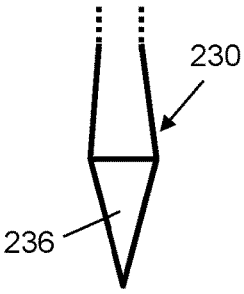
FIG. 8*f* is a side view of a lower end of a upright segment in another embodiment.

Other constructions are possible. For example, as shown in FIG. 4, the overlying portion 810 can include downwardly depending sidewalls, flanges, or brackets 830 which hold the underlying portion 820. The sidewalls, flanges, or brackets include returns, ribs, 840 or the like, to define a channel or receiving space 850 for the underlying portion. The underlying portion 820 can thus longitudinally move or slide with respect to the overlying portion 810 in the channel or receiving space 850. Conversely, the overlying portion can move in a channel or receiving space provided by upwardly extending sidewall, flanges, or brackets on the underlying portion. Alternatively, as shown in FIG. 5, the overlying portion 910 and underlying portion 920 can be assembled by placing male connectors 930, e.g. positioning studs or pegs or other connectors located on one portion, into receiving female connectors or ports 940 located on the other portion. Still other assembly methods can be used. For example, as shown in FIG. 6, a loop and hook arrangement can be used, whereby hooks 1030 and loops 1040 are respectively affixed to the surfaces of the overlying portion 1010 and the overlying portion 1020 which face each other in use, or vice versa. As a further example, as shown in FIG. 7, the overlying portion 1110 can include grooves or tracks 1120 provided in its under surface 1130. The underlying portion 1140 can have cooperating ribs 1150 which are dimensioned to fit into and slide in the tracks 1120.

Figure 9:
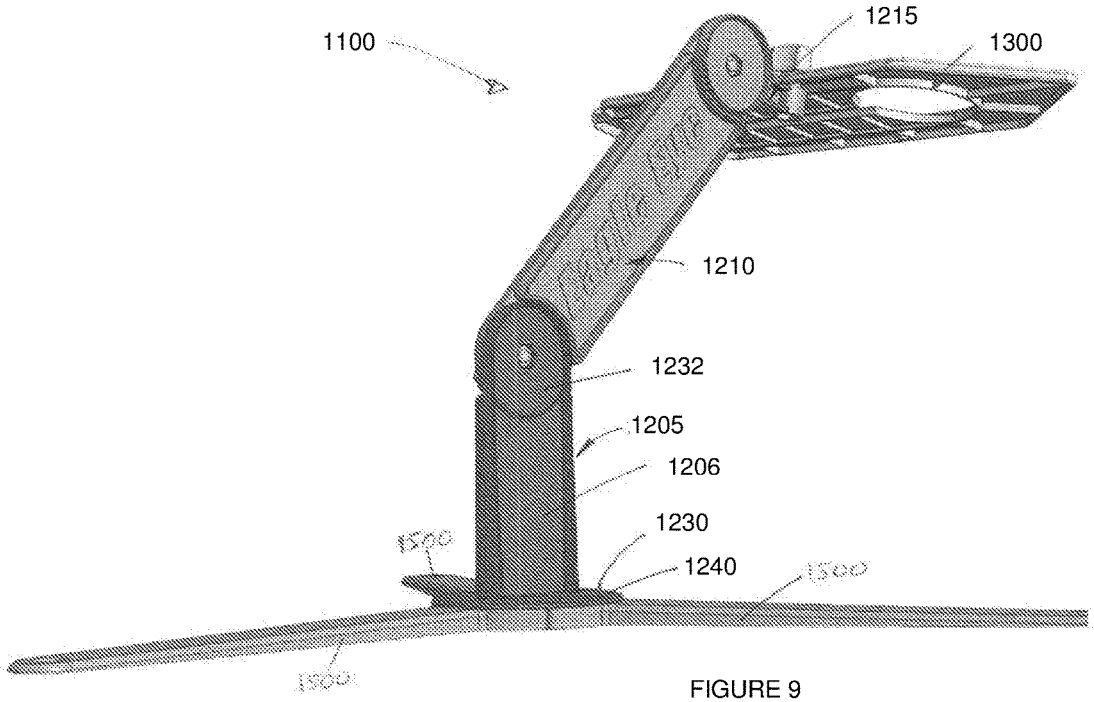
FIG. 9 is a perspective view of anther embodiment of the golf training device.

FIG. 9 depicts a golf swing training device 1100 with an alternative construction for the support stand 1200 and the visual guide 1300. The depicted training device support 1200 has an upright 1205, a pivot arm 1210, and a visual guide arm 1215, similar to the embodiment depicted in FIGS. 1 and 2. The upright 1205 and pivot arm 1210 each generally has a flattened rectangular, obround, or oblong shape defined by two opposite lateral faces, and a generally rectangular cross section.

Figure 10A:
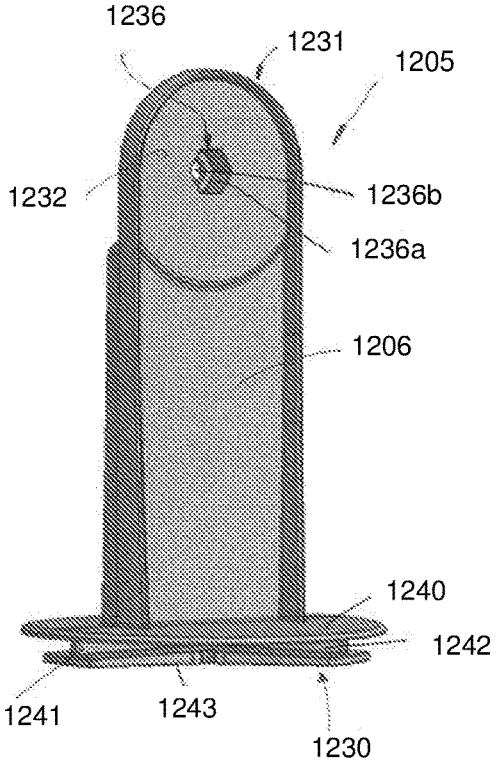
FIG. 10*a* is a perspective view of a upright arm.
Figure 10B:
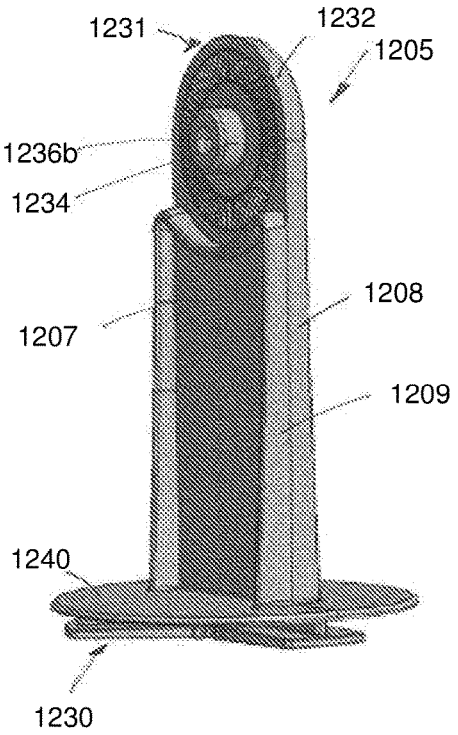
FIG. 10*b* is a reverse perspective view of the upright arm shown in FIG. 9*a;*

As shown in FIGS. 10*a* and 10*b*, the upright 1205 has two lateral faces 1206, 1207 with a rounded upper end 1231. The upright 1205 is generally longitudinal and is adapted to be placed on the ground or secured into the ground, with its longitudinal axis being in an upright orientation. The upright 1205, pivot arm 1210, and visual guide arm 1215, are connected in a different manner than the same components in the embodiment shown in FIG. 1, but the general working principle of the training device is similar.

On the upper end 1231 of the upright 1205, the lateral half 1208 of the upright 1205 bearing the lateral face 1206, has a longer extent than the other lateral half 1209 of the upright 1205 which bears the opposite lateral face 1207. The portion of the longer lateral side 1208 which extends further than the shorter lateral side 1209 is an upright connection part 1232. The upright connection part 1232 has a central boss 1234 which extends perpendicularly away from the upright connection part 1232 and toward the shorter lateral side 1209. The central boss 1234 surrounds an aperture 1236 which extends through the upright arm connector 1232. The aperture 1236 includes, adjacent the longer lateral face 1206, a hexagonal opening 1236*a*, adapted to capture a a locking nut or bolt head within the opening. The hexagonal opening 1236*a* leads into a cylindrical bore 1236*b* which has a reduced diameter compared to the hexagonal opening 1236*a*. The upright connection part 1232 in this embodiment replaces the pair of extension tabs 220*a*, 220*b* included in the embodiment depicted in e.g. FIG. 1, to allow connection between the upright 1205 and the pivot arm 1210.

Figure 10C:
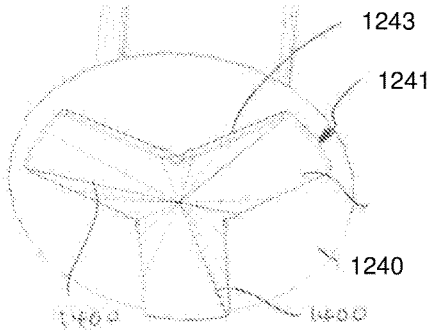
FIG. 10*c* is a bottom perspective view of the upright arm shown in FIG. 9*a;*
Figure 11A:
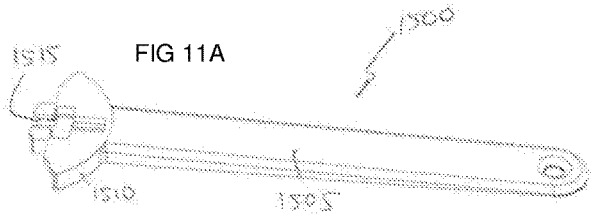
FIG. 11*a* is a perspective view of a support foot attachable to the upright arm shown in FIG. 9*a* and FIG. 9*b;*
Figure 11B:
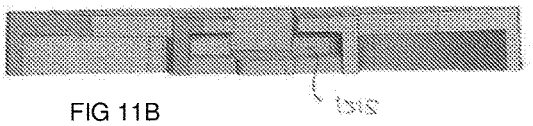
FIG. 11*b* is another perspective view of a support foot attachable to the upright arm shown in FIG. 10*a* and FIG. 10*b;*

On the lower end 1230 of the upright 1205 there is provided a base 1240. The base 1240 lies generally in a plane perpendicular to the longitudinal axis of the upright 1205. Support feet 1500 (shown in FIG. 9 and FIGS. 11*a* to 11*c*) are attached to the base 1240 so that the training device 1100 can placed on the ground or the floor. As shown in FIGS. 11*a* to 11*c*, the underside of the base 1240 carries a number of ground support attachment connectors 1241. In the depicted embodiment, each ground support attachment connector 1241 includes flange 1243 which is located at a distance below the base 1240. The flange 1243 lies in a plane that is generally parallel to that of the base 1240, and is connected to and spaced from the base 1240 by a web 1242 which extends perpendicularly between the base 1240 and the floor 1243. The webs 1242 and flanges 1243 take a trifurcated form (see FIG. 10*c*), with three branches 1400 which extend from a centre hub. However the web 1242 and flanges 1243, or more generally the ground support attachment connector 1241 itself, can have a different number of branches instead of three.

As shown in FIGS. 11*a* to 11*d*, the ground support attachment connector 1241 is used in conjunction with one or more ground support feet which support the upright 1205 vertically above the ground. FIG. 11*a* depicts a foot 1500 which is attachable to one branch of the trifurcated ground support attachment connector 1241. The foot 1500 includes a body 1505 and a head 1510. The head 1510 is adapted for connection with the ground support attachment connector 1241. The head 1510 has a thickness which allows it to be fitted snugly between the flange 1243 and the base 1240 of the upright 1205. A slot 1515 provided in the head 1510 is adapted to receive a branch of the web 1242 and the flange 1243. Therefore as shown in FIG. 11*b*, the slot 1515 is generally shaped like an inverted "T" when viewed into the direction of insertion for the ground attachment connector 1241. The number of feet 1500 provided will therefore correspond to the number of branches in the ground support attachment connector 1241. To achieve a sufficiently tight fit to retain the feet 1500 to the ground support attachment connector 1241, each foot 1500 includes tapered portions 1520, 1525 adjacent the slot 1515 which accepts the branch 1400 of the ground attachment connector 1341. The tapered portions are thinner adjacent the opening into the slot to ease the insertion of the branch 1400, and are thicker toward the inner parts of the slot to achieve a friction fit between the foot 1500 and the branch 1400. Three feet 1500 are included in the embodiment of the training device shown in FIG. 9, which is suitable to be placed on the floor, the ground, or a floor or grounded supported location.

Figure 11D:
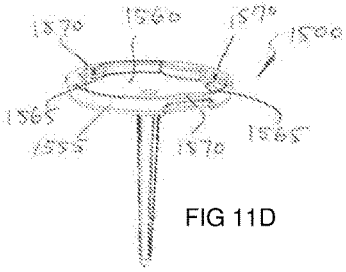
FIG. 11*d* is another perspective view of a support foot attachable to the upright arm shown in FIG. 10*a* and FIG. 10*b;*
Figure 11C:
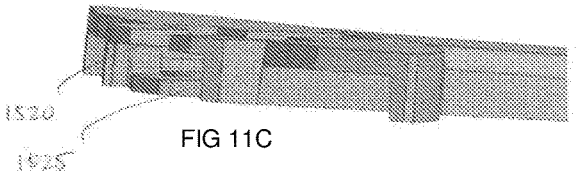
Figure 12:
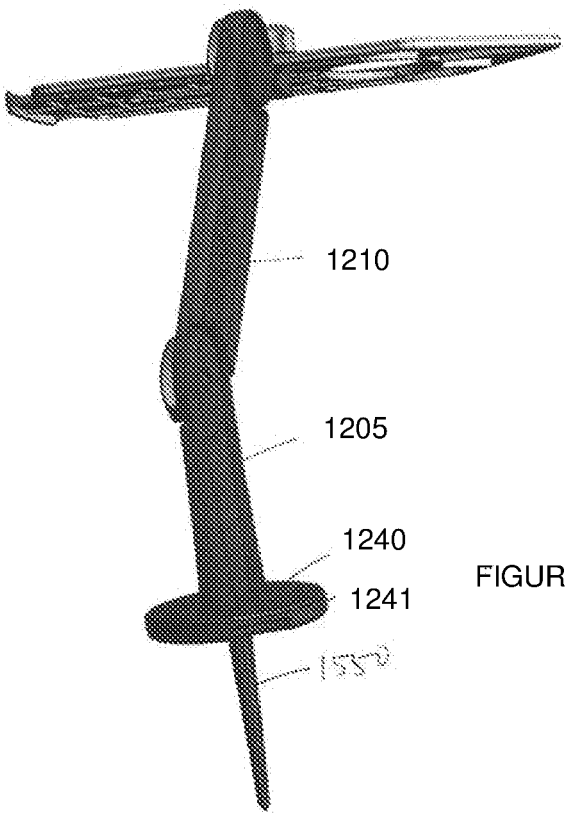
FIG. 12 is a perspective view of anther embodiment of the golf training device.

FIG. 11*d* depicts a different type of ground support attachment, being a spike 1550 having a connecting head 1555 which is adapted to be secured to the ground support attachment connector 1241. The connecting head 1555 has a connector receiving recess 1560. The connector receiving recess 1560 is also generally shaped to accommodate the branches in the ground support attachment connector 1241. The part of the receiving recess 1560 which will initially accommodate the free ends of the branches is in communication with keyways 1565 located beneath overhanging projections 1570. The projections 1570 are located at the upper end of the connecting head 1555 and extend inwardly. To assemble the ground insertion device, the connecting head 1555 and the ground attachment support connector 1241 are assembled so that the receiving recess 1560 accommodates the ground support attachment connector 1241. The ground support attachment connector 1241 will be initially be aligned so that the branches align between the locking projections 1570. The connecting head 1550 is then rotated in relation to the ground attachment connector 1241, or vice versa, so that the flange 1243 of the ground support attachment connector 1241 is at least partially accommodated by the keyways 1565 and retained by the locking projections 1570. The resulting golf training device is depicted in FIG. 12.

Figure 13A:
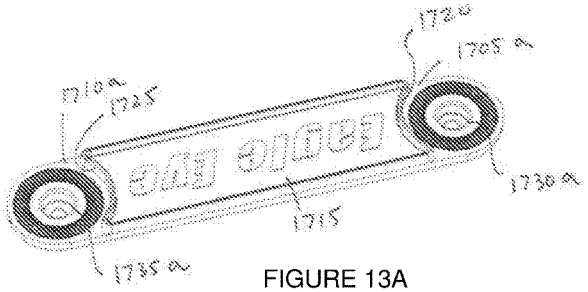
FIG. 13*a* is a perspective view of a pivot arm.
Figure 13B:
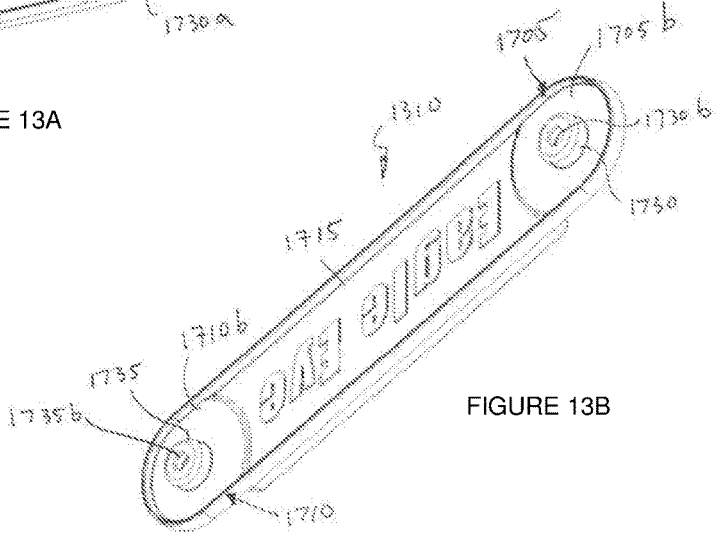
FIG. 13*b* is a reverse perspective view of the pivot arm shown in FIG. 13*a;*

FIGS. 13*a* and 13*b* depict the pivot arm 1210 shown in FIG. 9. The pivot arm 1210 has a generally flat and oblong or obround shape. The pivot arm 1210 has a pair of connection parts or tabs 1705, 1710, one at each of its two longitudinal ends. The pair of connection parts 1705, 1710 are identical in this embodiment. Each connection tab or part 1705, 1710 has a thickness that is reduced compared with the thickness of the remaining, central portion 1715 of the pivot arm 1210. The connection parts or connection tabs 1705, 1710. The central, thicker portion 1715 of the pivot arm 1210 extends between edges 1720, 1725 at each of its longitudinal ends, which in this embodiment are curved edges. Each curved edge 1720 (1725), with its corresponding connection part 1705 (1710), defines a space which is adapted to accommodate the upright connection part 1232 located on the upper end 1231 of the upright 1305. The thickness of the upright connection part 1232 will generally be accommodated by the thickness of the curved edge 1720 (1725). Therefore, the connection parts 1705, 1710 on the pivot arm 1310 are complementary with the upright connection part 1332. In use, either connection part 1705, 1710 can be used to form the connection with the upright arm 1305, and the remaining connection part will be used to form the connection with the visual guide arm 1315.

Therefore, each connection part 1705, 1710 is considered to have an inner face 1705*a*, 1705*b* and an outer face 1705*b*, 1710*b*. The inner faces 1705*a*, 1705*b* are oriented toward the upright connection part 1232 when the pivot arm 1210 and upright 1205 are assembled. The outer faces 1705*a*, 1705*b* are oriented (i.e. facing) away from the upright connection part 1232 when the pivot arm 1210 and upright 1205 are assembled.

As seen in FIG. 13*b*, each connection part 1705, 1710 has a protruding boss 1730, 1735 which extends perpendicularly from the corresponding connection part 1705, 1710, in the direction which will be away from the upright connection part 1232 when the upright 1205 and pivot arm 1210 are assembled.

The protruding bosses 1730, 1735 are each provided around a passage 1730, 1735 through the respective connection parts 1705, 1710. The passages 1730, 1735 each include a first cylindrical bore 1730*a*, 1735*a* adjacent the inner faces 1705*a*, 1705*b* of the connection parts 1705, 1710. The first cylindrical bores 1730*a*, 1735*a* are adapted to receive the protruding boss 1334 on the upright connection part 1332. The first cylindrical bores 1730*a*, 1735*a* then respectively lead into second cylindrical bores 1730*b*, 1735*b* which have a reduced diameter compared to the first cylindrical bores 1730*a*, 1735*a*.

Figure 14A:
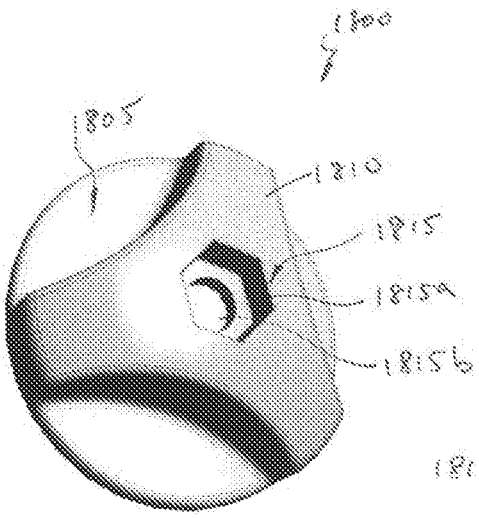
FIG. 14*a* is a perspective view of a knob.
Figure 14B:
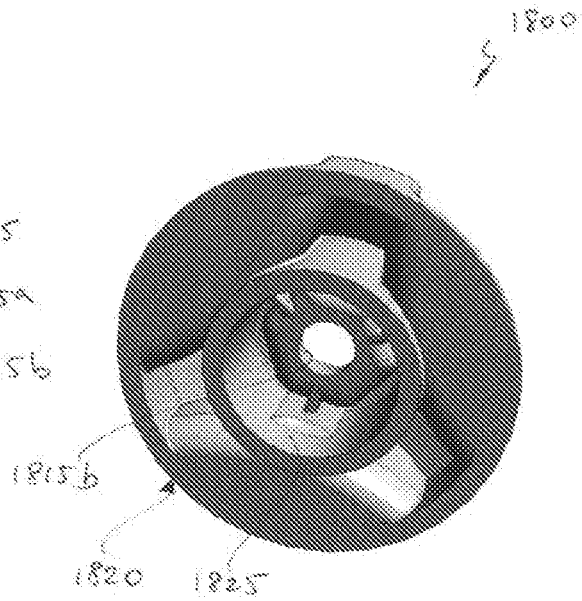
FIG. 14*b* is a reverse perspective view of the knob shown in FIG. 13*a;*

FIGS. 14*a* and 14*b* show a knob 1800, which has an outer portion 1805 which is manipulable by a user. As shown in FIG. 9, the knob 1800 is provided at the connection between the upright 1205 and the pivot arm 1210, and also between the pivot arm 1210 and the visual guide arm 1215. A grip portion 1810 is provided for easier handling of the knob 1800. A centrally located knob aperture 1815 is provided through the outer portion 1805 and leads to the underside 1820 of the knob 1800. The knob aperture 1815 has a hexagonal portion 1815*a* which then leads into a cylindrical portion 1815*b* which is reduced in sized compared to the hexagonal portion 1815*a*. The knob aperture 1815 allows for the insertion of a bolt with a hexagonal head. The shaft of the bolt will be accommodated by the cylindrical portion 1815*b* whereas the hexagonal head will be accommodated by the hexagonal portion 1815*a* of the knob aperture 1815. Once the bolt is inserted into the knob aperture 1815, turning the knob 1800 about the axis of the aperture 1815 will also turn the bolt, because the surfaces around the hexagonal portion 1815*a* of the aperture 1815 will drive the hexagonal head of the bolt. It should be noted that the hexagonal portion 1815*a* can instead have a different shape to accommodate a bolt having a differently shaped head, as along as the shaped portion 1815*a* is able to drive and thus cause the correspondingly shaped bolt head to turn.

Figure 15:
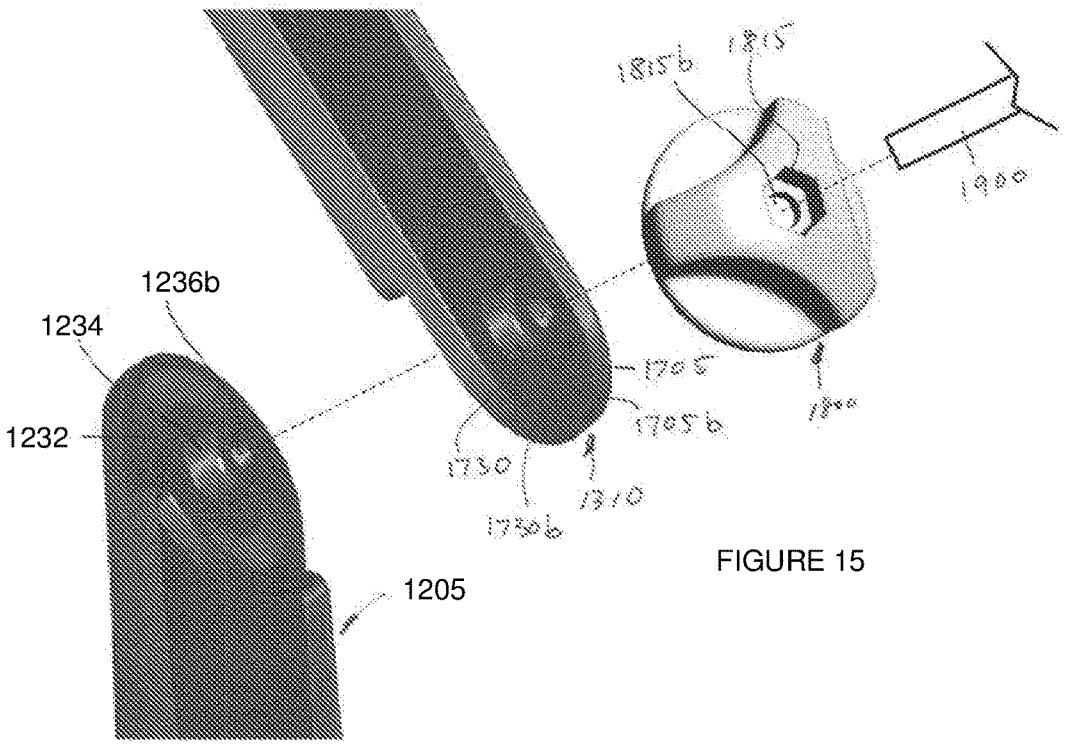
FIG. 15 is an exploded perspective showing aligned upright connection part, pivot arm connection part, a knob, and a bolt.

The underside 1820 of the knob 1800 is adapted to be mounted onto the protruding boss 1730 (or 1735) of the pivot arm connection part 1705 (or 1710) which will form the connection with the upright 1705. Therefore, on the underside 1815 of the knob 1800 there is provided a skirt or cylindrical wall surrounding a bore 1825 which is adapted to receive the protruding boss 1730 (or 1735). The bore 1825 is in communication with the through aperture 1815 of the knob. When the knob 1800, pivot arm 1210, and the upright 1205 are assembled, the cylindrical portion 1815*b* of the through aperture 1815, the smaller cylindrical bores 1730*b* (1735*b*) in the pivot arm 1710, and the cylindrical bore 1236*b* of the protruding boss 1234 on the upright, are in registry with one another. As depicted in FIG. 15, the shaft 1900 of the bolt which is inserted into the knob aperture 1815 will be inserted into, in sequence, the cylindrical portion 1815*b* of the through aperture 1815, the passage surrounded by the pivot arm protruding boss 1730 (or 1735), and then the upright's protruding boss 1234. The bolt 1900 will extend all the way through and out of the cylindrical bore 1236*a* of the upright's protruding boss 1334, so that a locking nut (not shown) can be screwed onto the bolt to lock the parts together. FIG. 15 also illustrates that the upright connection part 1232, the pivot arm connection part 1705 (1710), and the knob 1800 are correspondingly sized and shaped to match with each other.

Figure 16A:
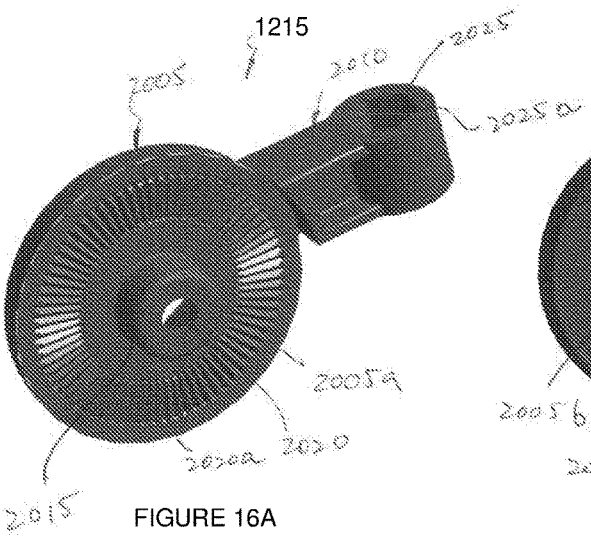
FIG. 16*a* is a perspective view of a visual guide arm.
Figure 16B:
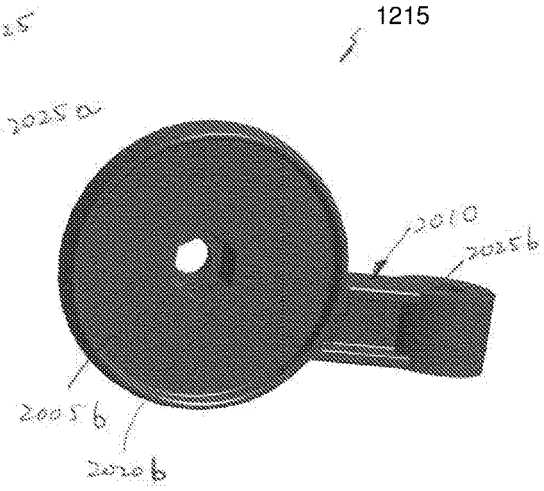
FIG. 16*b* is a reverse perspective view of the visual guide arm shown in FIG. 15*a;*

FIGS. 16*a* and 16*b* depict the visual guide arm 1215. The visual guide arm includes a support connection part 2005, which is adapted to form a connection with the remaining pivot arm connection part 1735. The support connection part 2005 is attached to a guide connection part 2010, which is adapted to form a connection with the visual guide 2300. The support connection part 2005 is generally shaped as a circular disc but the exact shape does not need to be circular. The shape of the support connection part 2005 allows it to be accommodated within the space generally defined by the pivot arm connection part 1735 and the raised central portion edge 1725 adjacent the pivot arm connection part 1735.

The support connection part 2005 has an inner face 2005*a* which in use will face the pivot arm 1210, and an outer face 2005*b* opposite the inner face 2005*a* which will face away from the pivot arm 1210. A central protruding boss 2015 extends perpendicularly from the inner face 2005*a* of the support connection part 2005. The central boss 2015 surrounds a passage 2020 which includes a cylindrical bore 2020*a* which is in communication with an enlarged aperture 2020*b*, which in this case is hexagonal to accept a conventional locking nut.

The guide connection part 2010 has a second through aperture 2025 located at the end of the guide connection part 2010 which will be closest to the visual guide 1300 (see FIG. 9). The axis of the second through aperture 2025 is perpendicular to the axis of the through aperture 2020 provided through the boss 2015 on the support connection part 2005. The second through aperture includes a cylindrical bore 2025*b* which leads into an enlarged opening 2025*a*. The enlarged opening 2025*a* is hexagonal in this embodiment, but the hexagonal shape is not required as long as a locking nut can be accommodated. The cylindrical bore 2025*b* will be located closest to the visual guide 300 when the visual guide is assembled onto the visual guide arm 1315.

Figure 17:
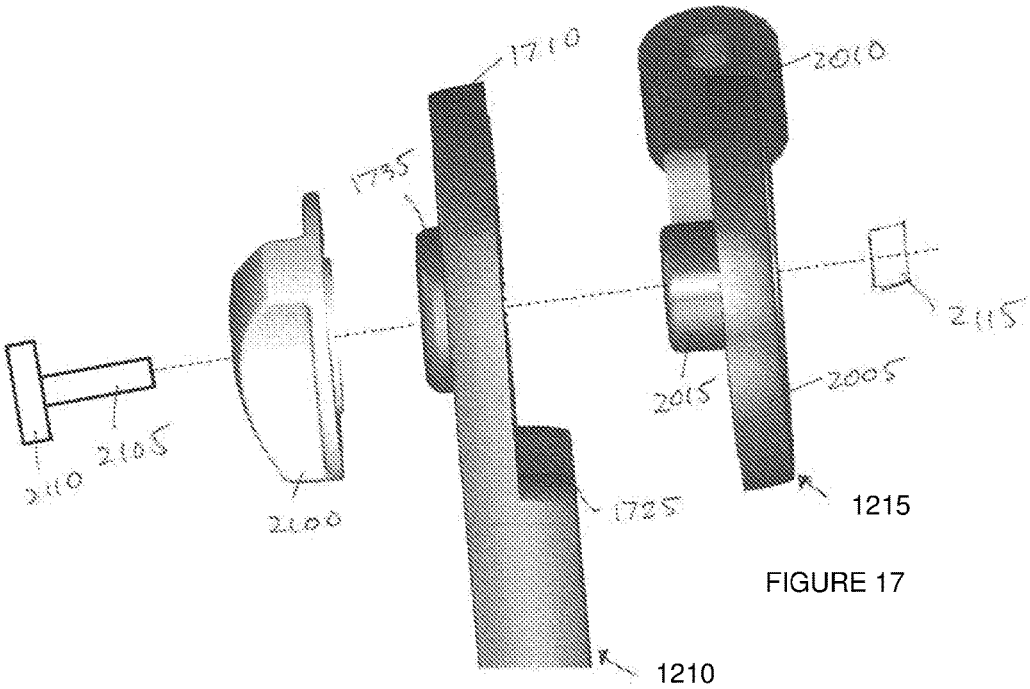
FIG. 17 is an exploded perspective showing aligned pivot connection part in the pivot arm, support connection part in the visual guide arm, a knob, and a bolt.

As shown in FIG. 17, the manner in which the visual guide arm 1215 and the pivot arm 1210 are connected is the same as that in which the pivot arm 1210 and the upright 1205 are connected. The opposite end of the pivot arm 1210 is adapted to be attached to the visual guide arm 1215. The connection between the pivot arm 1210 and the visual guide arm 1215 is similar to that between the pivot arm 1210 and the upright 1205. The support connection part 2005 is aligned with the pivot arm support part 1710 so that the central passages in the respective protruding bosses 2015, 1735 are in registry. The protruding boss 2015 of the visual guide arm 1315 will be received by the enlarged cylindrical bore portion 1735*a* in the pivot arm 1310. A second knob 2100 having the same features as the first knob 1800 is mounted onto the protruding boss 1735 of the pivot arm 1310. The aligned apertures accept a bolt 2105 which will extend all the way through the knob 2100, the pivot arm 1210, and the visual guide arm 1215. As mentioned before, the knob 2100 will have an enlarged aperture whose wall provides a driving surface to drive the head 2110 of the bolt 2105. The end portion of the bolt 2105 engages a locking nut 2115 which locks the parts together.

Figure 18B:
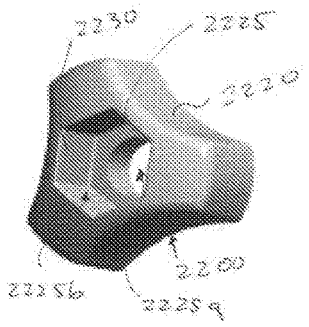
FIG. 18*b* is an exploded perspective showing aligned guide connection part in the pivot arm, bolt driver shown in FIG. 18*a*, a knob, a bolt, and a locking nut.
Figure 18A:
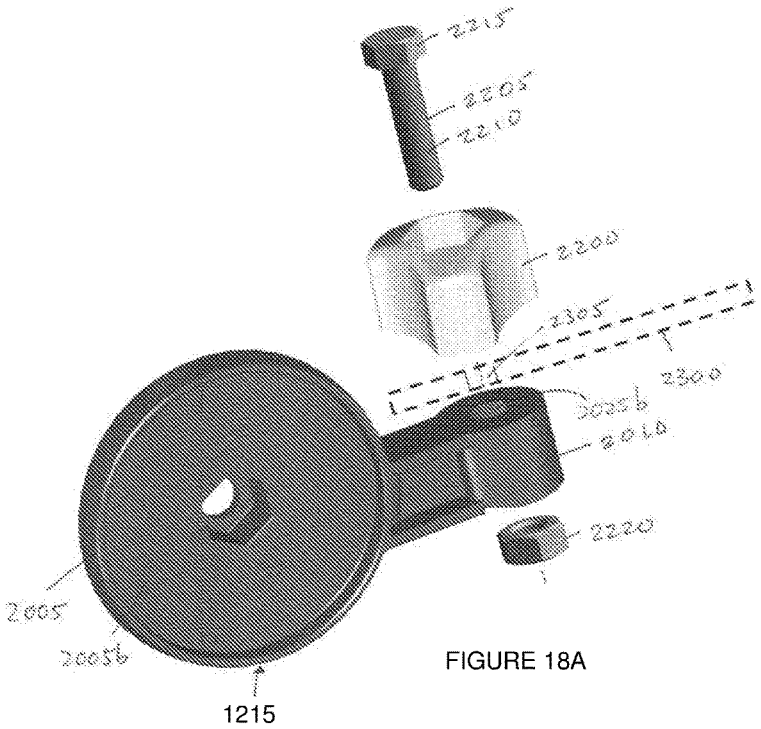
FIG. 18*a* is a perspective view of a bolt driver.

FIGS. 18*a* and 18*b* depict the connection between the visual guide arm 1215 and the visual guide 2300 (shown in dashed lines). The visual guide 2300 is provided with an assembly aperture 2305 which extends through the thickness of the visual guide 2300. The assembly aperture 2305 is placed adjacent to and in registry with the cylindrical bore 2025*b* provided in the guide connection part 2010 of the visual guide arm 1315. The aligned aperture 2305 and bore 2025*b* are adapted to accept the shaft 2210 of a bolt 2205.

FIG. 18*b* depicts a knob or bolt driver 2200 which is provided to drive the head 2215 of the bolt 2205. The bolt driver 2200 preferably includes a finger grip portion, such as a finger groove 2220, for easy user maneuvering. A central passage 2225 is provided through the bolt driver 2200, the passage 2225 including a cylindrical portion 2225*a* to accept the shaft 2210 of the bolt 2205, and an enlarged opening 2225*b* to accommodate the head 2215 of the bolt 2205. The surfaces of the bolt driver 2200 which surround the enlarged opening 2225*b* include a driving surface 2230. The driving surface 2230 is adapted to drive the head 2215 of the bolt 2205 when the bolt driver 2200 is rotated. In the depicted embodiment, the driving surface(s) is provided by the wall surrounding the hexagonal enlarged opening 2225*b*.

Figure 19A:
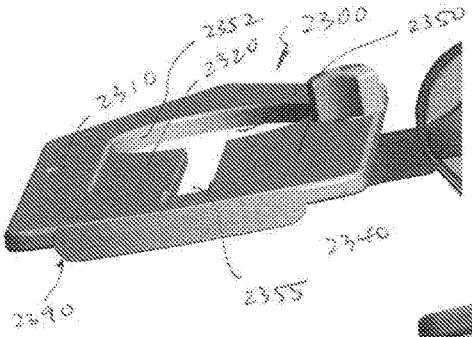
FIG. 19*a* is a perspective view of a visual guide.
Figure 19B:
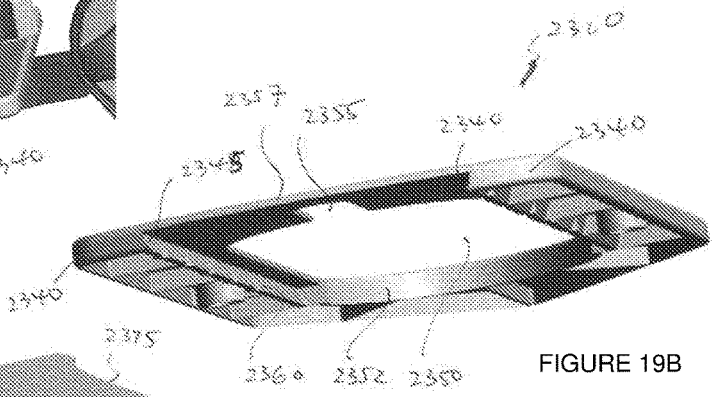
FIG. 19*b* is a perspective view of a top visual guide portion.

FIG. 19*a* depicts a visual guide 2300, which includes a top or overlying portion 2310 and a bottom or underlying portion 2320, similar to the visual guide 300 or 1300 depicted in the previous embodiments. Along the longitudinal centre of the top portion 2310, there is provided a central aperture which includes a front window 2350 which is in communication with a narrower rear passage 2355. As best shown in FIG. 23*b*, the top portion 2310 includes two downwardly depending side formations 2340, one on each lateral side of the top portion 2310. The inner sidewall 2345 of each side formation 2340 is sloped to taper downwardly and inwardly to the longitudinal axis of the top portion 2310. The inner sidewalls 2345 further each include a series of identical indentations, recesses, or grooves 2360, which can be spaced apart evenly. Each indentation 2360 on one sidewall has a corresponding indentation at the same longitudinal position on the opposite sidewall.

Figure 19C:
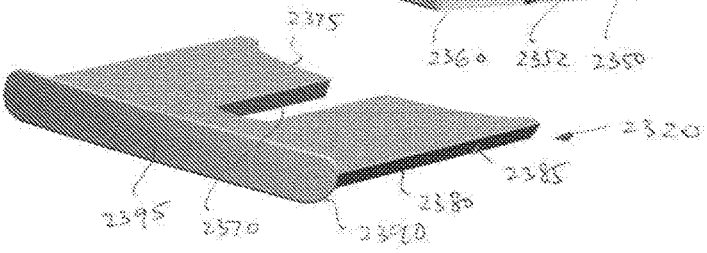
FIG. 19*c* is a perspective view of a bottom visual guide portion.

FIG. 19*c* depicts the bottom or underlying portion 2320 of the visual guide 2300. The bottom portion 2320 includes a central passage 2370 provided in lateral alignment with the central passage 2355 of the top visual guide portion 2310. The central passage 2370 extends from a leading edge 2375 of the bottom portion 2320. The leading edge 2375 is curved or otherwise shaped to complement a leading edge 2352 of the front window 2350 in the top visual guide portion 2310.

The lateral sidewalls 2380 of the bottom visual guide portion 2320 are sloped, tapering downwardly and inwardly to the longitudinal centre of the visual guide. The slope in the lateral sidewalls 2380 of the bottom visual guide portion 2320 complements the slope in the inner sidewalls 2345 of the side formations 2304 of the top visual guide portion 2310. That is, the lateral sidewalls 2380 of the bottom visual guide portion 2320 are sized and shaped to be held between the inner sidewalls 2345 of the side formations 2304 in the top visual guide portion 2310. The lateral sidewalls 2380 of the bottom visual guide portion 2320 further each includes a resilient projection 2385, located at corresponding lateral positions about the central axis of the bottom visual guide portion. The projections 2384 are adapted to fit within a pair of corresponding indentations 2360, one on each inner sidewall 2380 of the bottom visual guide portion 2320. The position of the bottom visual guide portion 2320 in relation to the top visual guide portion 2310 is determined by the position of the side projections 2385, which can be one of a plurality of potential positions as determined by the positions of the indentations 2360. The trailing edge 2390 of bottom visual guide portion 2320 is prevented from entering the space beneath the top visual guide portion 2310, by a trailing flange 2395. The trailing flange 2395 is blocked by the trailing edge 2357 of the top visual guide portion 2310.

The complementary configuration between top visual guide portion 2310 and the bottom visual guide portion 2320, provided by the sloped sidewalls in the respective portions, and also by the engagement between the projections 2385 and the pair of corresponding indentations, ensures that the bottom visual guide portion 2320 is retained by the top visual guide portion 2310.

To use the golf training device 100 or 1100, a user will place the device 100 or 1100 along the target line, and then stand behind the device. He or she can then adjust the support 200 or 1200, or the guide 300, 1300 so that the guide appears to align with the target line from the viewing angle from the user's perspective. The guide is also positioned so that the golf-ball appears in the golf-ball viewing window. The swivel position in the visual guide 300, relative to the support 200, 1200 and the positions of the pivotable segments in the support 200, 1200 are adjustable as previously described, to change the height and angle of the visual guide 300, 1300, to accommodate the stroke that is intended, the club that is being used, and also the height of the user. A novice golfer, who is less adept at keeping his or her gaze steady on the golf-ball, may adjust the portions of the visual guide 300, 1300 to allow a larger golf-ball viewing area. The golfer may adjust the visual guide 300, 1300 to allow a smaller golf-ball viewing window when he or she progresses.

Once the golf training device 100, 1100 is set up, the user assumes his or her stance and practices swinging. Following the visual guide for alignment, the user can practice swinging while keeping his or her head relatively still, and may with practice improve the accuracy of his or her swing.

The user may also use the device to practice an inside-to-outside swing plane, which may help increase greater distance.

When not in use, the golf training device 100, 1100 is collapsible for storage or transport. The support segments 205, 210, 215, (or 1205, 1210, 1215) being hinged together, can be rotated and thus folded with respect to each other to collapse the device.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A golf swing training device comprising:

a ground support configured to be positioned on the ground in front of a golfer; and a visual guide, comprising:

a front guide formed with a central aperture having a leading edge and an elongate swing alignment window extending from a side of said central aperture opposite said leading edge;

a visual guide arm rotatably connected to said ground support and rotatably connected to said front guide; and a rear guide connected to said front guide, said rear guide having a leading edge forming an edge of a rear window, and said rear guide formed with an elongate central passage extending longitudinally away from said rear window, wherein said edge of said rear window is visible through said central aperture of said front guide.

2. The golf swing training device as claimed in claim 1, wherein said visual guide includes a protractor for indicating an angular position of said visual guide relative to said visual guide arm.

3. The golf swing training device as claimed in claim 1, wherein said ground support further includes:

a base;

an upright attached to said base; and a pivot arm rotatably connected to said upright and to said visual guide arm.

4. The golf swing training device as claimed in claim 3, wherein said base includes a ground spike.

5. The golf swing training device as claimed in claim 1, wherein said device is reconfigurable between a left-handed and a right-handed configuration by repositioning said visual guide arm on said visual guide.

6. The golf swing training device as claimed in claim 1, wherein said rear guide is longitudinally movable relative to said front guide.

7. The golf swing training device of claim 1, wherein said visual guide arm extends laterally outward from said visual guide.

8. The golf swing training device of claim 1, wherein said swing alignment window through said front guide is laterally aligned with said central passage through said rear guide.

9. The golf swing training device of claim 1, wherein a golf ball viewing window is formed by said rear window in said rear guide and said central aperture in said front guide.

10. The golf swing training device of claim 1, wherein said rear guide is slidably coupled to said front guide.

11. The golf swing training device of claim 10, wherein said rear guide slides in a channel formed in said front guide.

12. The golf swing training device of claim 10, wherein said front guide slides in a channel formed in said rear guide.

* * * * *